US005732613A

United States Patent [19]

Stoll et al.

[11] Patent Number: 5,732,613

[45] Date of Patent: Mar. 31, 1998

[54] FLUID OPERATED ROTARY DRIVE WITH POSITION DETECTOR

[75] Inventors: Kurt Stoll, Esslingen; Gerhard Thorwart, Filderstadt; Albrecht Wagner, Winterbach, all of Germany

[73] Assignee: Festo KG, Esslingen, Germany

[21] Appl. No.: 823,497

[22] Filed: Mar. 25, 1997

[30] Foreign Application Priority Data

Mar. 28, 1996 [DE] Germany ..... 296 05 723 U

[51] Int. Cl.[6] ..... F01B 25/26

[52] U.S. Cl. ..... 92/5 R; 92/13.5; 92/121; 92/125

[58] Field of Search ..... 92/5 R, 13.5, 13, 92/120, 121, 125

[56] References Cited

U.S. PATENT DOCUMENTS

| | | | |
|---|---|---|---|
| 2,778,338 | 1/1957 | Shafer | 92/13.5 |
| 3,171,332 | 3/1965 | Randle | 92/13.5 |
| 4,492,150 | 1/1985 | Yates . | |
| 5,622,096 | 4/1997 | Granberg | 92/5 R |

FOREIGN PATENT DOCUMENTS

| | | |
|---|---|---|
| 0 479 399 A2 | 4/1992 | European Pat. Off. . |
| 40 29 815 A1 | 4/1991 | Germany . |
| 39 41 255 A1 | 6/1991 | Germany . |
| 39 43 716 C2 | 6/1991 | Germany . |
| 40 41 090 A1 | 6/1992 | Germany . |
| 295 18 346 U1 | 2/1996 | Germany . |
| 5-26 327 | 7/1993 | Japan . |
| 5-82 140 | 11/1993 | Japan . |
| WO 96/01384 | 1/1996 | WIPO . |

*Primary Examiner*—Thomas E. Denion
*Attorney, Agent, or Firm*—Hoffmann & Baron, LLP

[57] ABSTRACT

A fluid operated rotary drive, which possesses a drive means having an output drive shaft able to be driven for oscillating motion. On one axial side of the drive means a position detection means is arranged, which possesses an actuating member connected with the output drive shaft and which on rotary motion of the output drive shaft performs an oscillating movement about a pivot axis. The actuating member cooperates with sensors, which may be set on holders. Each holder is arranged on its own setting ring, such setting rings being arranged coaxially in relation to each other with the holders extending away from the drive means. The setting rings are able to be turned in relation to one another and furthermore in relation to the housing for setting the positions to be detected and may be fixed in the settings made.

14 Claims, 3 Drawing Sheets

FLUID OPERATED ROTARY DRIVE WITH POSITION DETECTOR

BACKGROUND OF THE INVENTION

The invention relates to a fluid operated rotary drive comprising a drive means which has an output drive shaft able to be driven for oscillating motion and has a housing, on whose one axial side a position detecting means is arranged, such position detecting means having at least one actuating member connected in such a manner as to prevent relative rotation with the output drive shaft and adapted, on rotary movement of the output drive shaft, to move along a circularly arcuate path of movement about a pivot axis, and two holders arranged radially to the outside adjacent to the said path of movement of the actuating member, for sensors adapted to respond to the actuating member, said holders being able to be positioned along at least one section of such path of movement in desired detecting positions.

THE PRIOR ART

A fluid operated rotary drive of this type is example disclosed in the examined Japanese utility model JP 5-26327. The rotary drive is designed in the form of an oscillating vane drive and possesses a drive means by which the drive shaft may be driven to perform an oscillating rotary movement. For detection of certain angular positions of the output drive shaft, more particularly the two end positions thereof, a position detecting means is provided, which possesses an actuating member in the form of a permanent magnet adapted to be entrained with the output drive shaft. The actuating member performs a pivotal or oscillating movement along a circularly arcuate path, adjacent to which sensors are mounted with the aid of suitable holders so that such sensors respond on approach of the actuating member and produce a signal. For the adaptive detection of different angular positions it is possible for the holders of the sensors to be set in desired detection positions along the path of movement of the actuating member.

In the case of such prior art the holders of the sensors are arranged in a sliding manner on a guide ring secured to the housing. Such attachment is relatively insecure and when resetting the sensors may assume skew positions which makes handling more difficult.

Further similar rotary drives are disclosed in the examined Japanese utility model JP-6-47122 U, the unexamined Japanese utility model JP-7-25310 U and the Japanese patent JP-5-82140.

SHORT SUMMARY OF THE INVENTION

One object of the invention is to create a fluid operated rotary drive of the type initially mentioned, in the case of which the holders for the sensors are stably or firmly arranged while nevertheless being able to be simply reset.

In order to achieve these and/or other objects appearing from the present specification, claims and drawings, in the present invention each holder is permanently arranged on its own setting ring associated with it, the two setting rings being arranged in axial succession and in superposed relationship centered on the pivot axis of the actuating member, the holders extend, starting from the associated setting ring, in the axially opposite direction to the housing of the drive means, the setting ring placed on top having a recess extending along a section of its periphery for the holder, arranged on the underlying setting ring, to fit through, and for resetting the detection positions the two setting rings are able to be turned in relation to one another and in relation to the housing of the drive means about the pivot axis of the actuating member and may be locked in a releasable manner in the settings made in relation to the housing.

It is in this manner that each holder is supported over a comparatively large area using the setting ring associated with it so that for resetting the detection positions rotary resetting or adjustment is possible without the danger of running skew. The arrangement of the setting rings is all in all extremely stable and renders possible, as a particular advantage, a miniaturized design of fluid operated rotary drives. Because fixing in the settings made is performed using the setting rings, it is possible to prevent even a slight displacement out of position taking place when locking, which might otherwise lead to inaccuracy in the detection position.

Further advantageous developments of the invention are defined in the claims.

In accordance with one particularly advantageous development of the invention there is a provision such that the setting rings are in direct axial engagement with one another so that a particularly reliable mutual supporting and guiding action is ensured.

For supporting the two setting rings in a rotatable manner an axially projecting cylindrical bearing portion is preferably provided on the housing of the drive means. It is preferred for the top setting ring to have an axially projecting annular bearing collar by which it is directly supported in a rotatable fashion on the cylindrical bearing portion, fixed in relation to the housing, the annular bearing collar serving for its part as a rotary bearing portion for the bottom setting ring because it fits radially in an interlocking manner in the annular opening in the bottom setting ring.

The two setting rings are preferably able to be locked in place using a locking element, jointly on the drive housing. For this purpose the two setting rings each have an arcuate setting slot, there being, in accordance with the relative rotational position, a smaller or larger overlap of the two setting slots in the longitudinal direction of the slot, the locking element extending through both setting slots in the range of overlap. When the locking element is tightened the two rings are clamped in relation to the housing in such a manner as to prevent relative rotation and the respective detection setting is secured. When the setting locking element is in the released state it is possible for both setting rings to be turned and set in relation to each other and in relation to the housing of the drive means, a suitable relative angular setting and coordination of the lengths of the setting slots ensuring a sufficient amount of play for adjustment.

If the bottom setting ring has an additional further setting slot, which may be readily provided by having a section of the corresponding, longer first setting slot in the bottom setting ring, there is the possibility of locking the bottom setting ring and the holder, fixedly secured thereto, in relation to the housing in a manner independent of the top setting ring. It is convenient if in the released state of the two locking elements angular setting of the bottom setting ring is firstly performed. The setting made is then secured using the further locking element associated with the further setting slot. Owing to the first locking element, which is still released, it is possible now to re-position the top setting ring without affecting the bottom setting ring and then to lock it by actuation of the first locking element.

The holders for the sensors are preferably designed in the form of plug-in holders, which render possible assembly by insertion of the suitably designed sensors, more particularly in the axial direction.

The fluid operated rotary drive is to be more particularly capable of being miniaturized. In this respect it is preferred for the angle of rotation of the drive shaft to be permanently preset by the manufacturer by the use of suitable permanently fixed abutments which are arranged in the working chamber. Additionally or as an alternative, more particularly outside the working chamber it is possible for an angle of rotation setting means to be provided for providing for an adaptive preset for the angle of rotation of the output drive shaft. In order to render possible universal use of the position detecting means independently of the predetermined setting for the angular position, it may well be convenient for the actuating member, which is preferably in the form of a piece of permanently magnetic material, to be secured to a carrier arranged radially within the two holders, such carrier being adapted to be secured to a section of the shaft which is more particularly constituted by a terminal section of the output drive shaft, in different relative angular positions. For this purpose it is possible for the carrier to be adapted to be shifted in steps on the shaft section using a polygonal plug-in connection means.

In what follows the invention will be described in detail with reference to the accompanying drawings.

LIST OF THE SEVERAL VIEWS OF THE FIGURES.

Figure 1:
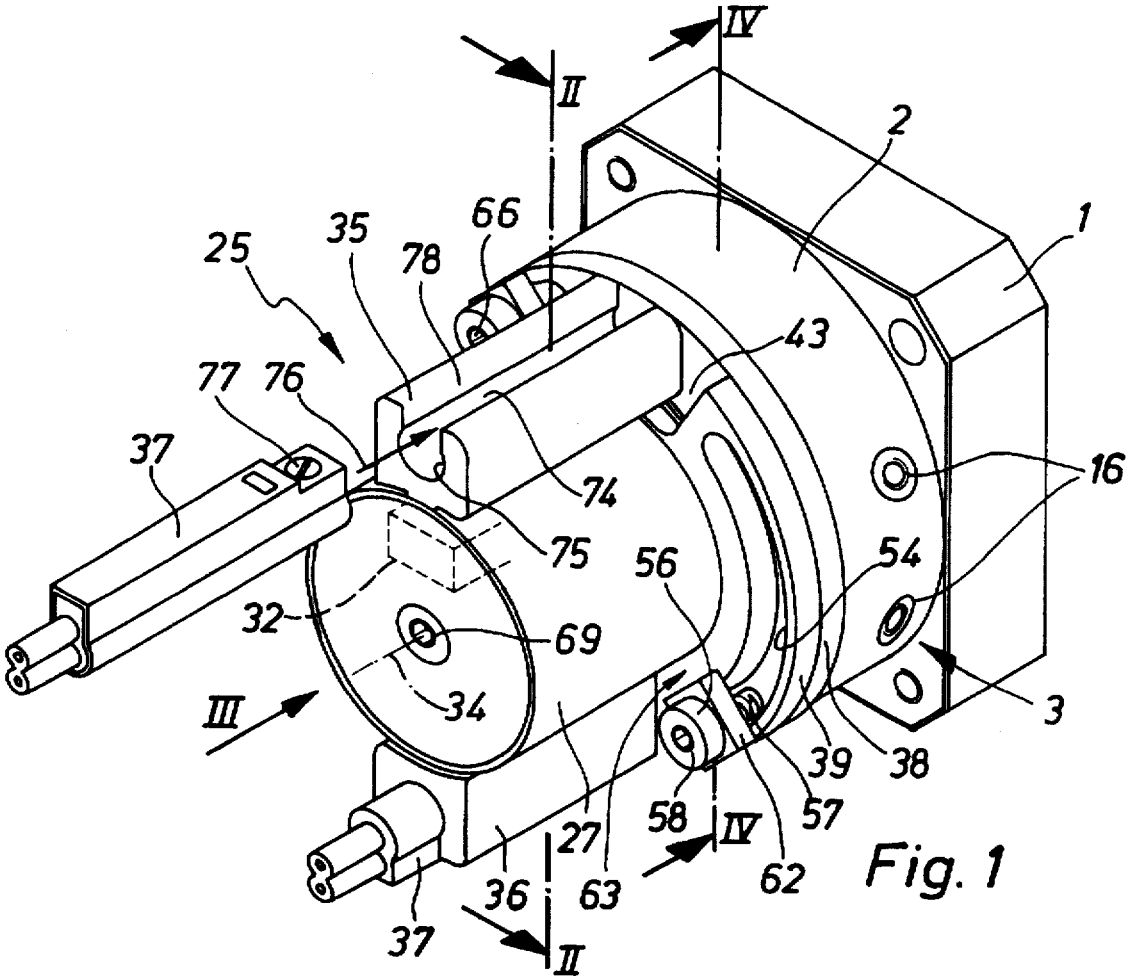
FIG. 1 shows a first constructional form of the rotary drive of the invention in perspective, one of the sensors being shown prior to attachment on the associated holder.

DETAILED ACCOUNT OF WORKING EMBODIMENTS OF THE INVENTION.

The fluid operated rotary drive of the present example is a pneumatically powered rotary drive in the form of an oscillating or pivoting vane drive. It possesses a mounting plate 1 for external attachment, on which a drive means 3 is secured by means of its housing 2. The basic design and arrangement of this drive means 3 may be the same as that disclosed in the German patent publication 3,941,255 C2. The principal features of the drive means 3 are a working chamber 4 in the interior of the housing 2, there being a chamber partition 5 permanently arranged in the chamber 4 to divide it in cooperation with a drive member 6, designed for instance in the form of an oscillating vane 7, into two pressure drive spaces 8 and 8' in a fluid-tight manner.

The oscillating vane 7 has a holding part 12 by which it is secured to a drive shaft 13 in such a manner as to prevent relative rotation, such shaft 13 having an output drive portion 11 extending from the front side of the drive means 3. It is here that any desired structure may be attached which is to be caused to perform an oscillating or rotary movement.

In the present example the oscillating vane 7 has its holding portion 12 releaseably slipped onto the output drive shaft 13 and there is an interlocking connection produced by splines or the like. However it would also feasible to have an integral design, more particularly in the case of small sizes.

At the periphery of the oscillating vane 7 there is a circumferentially extending seal 14, which cooperates with the internal wall face of the working chamber 4. Furthermore between the chamber partition or divider and the holding portion 12 there are means for producing a sealing effect, a suitable seal being indicated at 15.

Into each pressure drive space 8 and 8' there opens a power input duct 16 and 16', which extends to the external surface of the housing 2, where pressure medium lines may be connected for the supply and removal of pressure medium.

It is in this manner that the drive member 6 may be caused to perform an oscillating movement as indicated by the double arrow 17, this resulting in oscillating rotary motion of double arrow 17, this resulting in oscillating rotary motion of the output drive shaft 13 around the longitudinal axis 18 thereof.

It is preferred for the chamber partition 5 to simultaneously serve as an abutment means 22, which sets the maximum angular displacement or stroke of the output shaft 13 by limiting the pivotal movement of the drive member 6. In the present embodiment the abutment means 22 possesses abutment surfaces 23 and 23' facing the two side surfaces of the oscillating vane 7 and so positioned that the maximum angular stroke possible is 180°.

Figure 4:
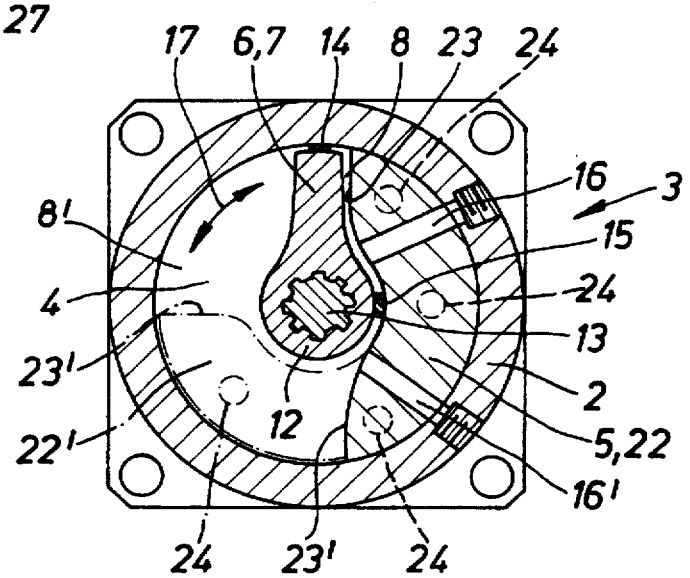
FIG. 4 is a cross section taken through the drive means of the rotary drive on the section line IV—IV in FIGS. 1 and 2.

The abutment means 22 is preferably detachably or releaseably placed in the working chamber 4 so that if required it can be replaced by another abutment means, which sets a fixed, different angular displacement or stroke. In FIG. 4 an extended abutment means is indicated in chained lines at 22', which when employed only permits an angle of pivot or oscillation of 90°. The locking means indicated at 24 respectively render possible an interlocking anchoring of the abutment means 22 and 22' in the working chamber 4.

Accordingly on the basis of a basic configuration the manufacturer may offer rotary drives with different maximum angular strokes, it only being necessary to incorporate different abutment means 22 and 22'.

In addition to such abutment means 22 and 22' arranged in the working chamber 4, or as an alternative thereto, it is possible to provide an external angular stroke setting means 81, arranged outside the working chamber, for adaptively presetting the maximum possible angular stroke of the drive shaft 13, a further description of such means 81 being provided below.

On the rear side, axially opposite to the output drive portion 11, of the drive means 3 a position detecting means 25 is arranged. It comprises a carrier 27, which is mounted in such a manner as to prevent relative rotation on a shaft section 26, extending to the rear from the housing 2 of the drive means 3, such shaft section 13 being connected with the output drive 26. It is preferred for the shaft section 26 to be constituted by the end portion, axially opposite to the output drive portion 11, of the output drive shaft 13 itself.

The carrier takes part in the rotary motion of the output drive shaft 13. At a radial distance from its longitudinal axis, which at the same time constitutes the axis 28 of rotation, it bears a piece of permanent magnet material as an actuating member 32. Same extends for merely a small angle about of the pivot axis 28 and is for example in the form of a wedge or slab. On rotary motion of the output drive shaft 13 taking place it is shifted along a circularly arcuate path 33 of movement so that it performs a pivotal movement in relation to the longitudinal axis 28, which in the present case constitutes a pivot or oscillation axis.

The angle of oscillation of the actuating member 32 is the same as the angular stroke of the output drive shaft 13 and consequently amounts to 180° in the illustrated working embodiment.

The position detecting means 25 furthermore possesses two holders 35 and 36 arranged radially to the outside adjacent to the path 33 of movement of the actuating member 32, one respective sensor 37 being detachably secured to each holder. The sensors 37 respond to the actuating member 32, when the same assumes a position which is essentially radially adjacent. Actuation takes place without making physical contact. In the present embodiment the sensors 37 are so-called reed switches, in which the magnetic field of the actuating member 32 causes electrical switch contacts to be closed, this leading to the production of a sensor signal.

The two holders 35 and 36 are so arranged that same radially flank the carrier 27 to the outside. It is a question for example of elongated components aligned in parallelism to the pivot axis 34. Each holder 35 and 36 is firmly mounted on its own particular setting ring 38 and 39, with which it preferably constitutes an integral unit.

The two setting rings 38 and 39 are disk-like in shape so that they extend in a plane which is at a right angle to their longitudinal axis. Their external diameters are preferably the same. They are arranged in axial succession so that they are superposed in a coaxial arrangement centered on the pivot axis 34 at the rear end 42 of the housing 2. Directly on the surface of such end 42 the one bottom setting ring 38 is placed for engagement over the full available area thereof, and in turn on the bottom setting ring 38 the further top setting ring 39 is placed, preferably with direct touching contact.

Each holder 35 and 36 is so arranged at the axial end, facing away from the drive means 3 of the respectively associated setting ring 38 and 39, that starting at such associated setting ring 38 and 39 it extends axially away from the housing 2. The carrier 27 is mounted between the two holders 35 and 26, the length of the holders being preferably at least approximately equal to the height of the carrier 27.

Figure 3:
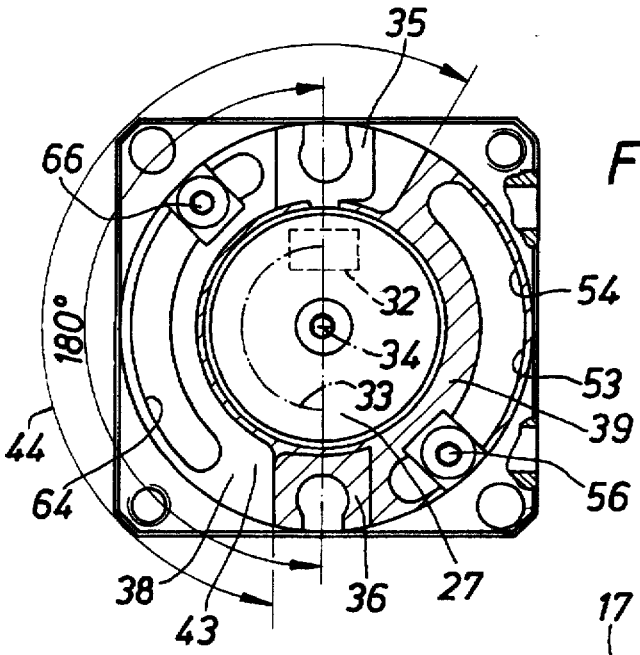
FIG. 3 is an axial rear view of the rotary drive in the direction of the arrow III in FIG. 1, one of the two setting rings being shaded to render it more distinct, this also applying for FIG. 5.

In order in the case of the bottom setting ring 38 to render possible the respective arrangement of the associated holder 35, the top setting ring 39 is provided with a recess 43 extending along a section of its periphery. The angular extent of this recess 43 is indicated in FIG. 3 by the double arrow 44. The recess 43 is open at the radial exterior side, it having a relatively large radial depth so that the respective setting ring 39 in its position only has available a narrow annular portion 45 in the radially inner portion. Owing to angular alignment of the recess 43 produced the holder 35 of the bottom setting ring 38 can now extend upward into the adjacent portion of the path 33 of movement of the actuating member 32.

Both setting rings 38 and 39 are mounted for rotary movement in relation to the housing 2.

On the rear end 42 of the housing 2 a bearing portion 46, which protrudes axially toward the rear side, is centrally located, which has a cylindrical bearing surface 47 facing radially outward. It serves for centering and directly rotatably supporting the top setting ring 39. On this top setting ring 39, at its annular opening 48, an annular bearing collar 51 is provided which projects coaxially toward the housing 2, serves to seat it on the cylindrical bearing portion 46 and to encompass the bearing surface 47 thereof radially to the outside in an interlocking manner. The structure is designed with such dimensions that the top setting ring 39 is radially centered while nevertheless being able to be turned in relation to the housing 2.

The means for rotatably supporting the bottom setting ring 38 involves top setting ring 39. It is mounted with its annular concentrically placed opening 52 on the bearing collar 51 of the top setting ring 39, whose bearing collar 51 practically extends into the radial intermediate space between the bearing portion 46, fixed in relation to the housing, and the inner surface of the bottom setting ring 38. Here as well the dimensions are such that the bottom setting ring 38 is radially centered by the top setting ring 39 while simultaneously however being able to be turned in relation to same.

Accordingly it is possible to turn the two setting rings 38 and 39 independently of each other in relation to the pivot axis 34 of the actuating member 32. Each holder 35 and 36 can consequently be set in a desired detection position along the path 33 of motion of the actuating member 32 in order to perform detection using the associated sensor, when the actuating member 32 reaches the respective setting.

It will be clear that the relative rotatability between the two setting rings 38 and 39 is dependent on the angular extent of the recess 43. This however does not cause any difficulties, since as a rule only the two end settings of the possible rotary movement are to be detected.

For releaseably locking in the settings made the two setting rings 38 and 39 may be releaseably fixed in relation to the housing.

In first place each setting ring 38 and 39 possesses an axially continuous, arcuate setting slot 53 and 54, whose center of curvature is the center of the ring and is accordingly on the pivot axis 34. They have the same curvature and are arranged at the same radial distance from the pivot axis 343. In the present embodiment of the invention they furthermore possess the same longitudinal extent in the longitudinal direction of the slot.

Figure 5:
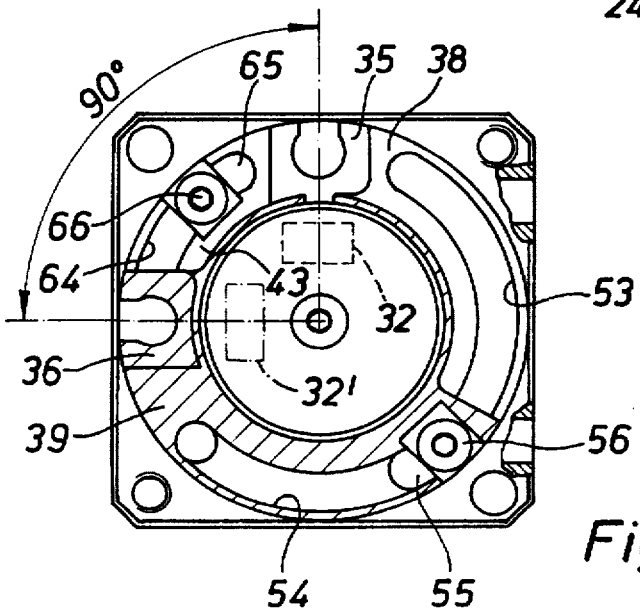
FIG. 5 is a rear view of the rotary drive in a manner of representation corresponding to that of FIG. 3, after a change in the setting of the position detection means.

The setting slots 53 and 54 are so arranged that they at least partly overlap in the longitudinal direction of the slot. By relative turning of the two setting rings 38 and 39 the degree of overlap can be changed. In the position as shown in FIG. 3 the degree of overlap is 100%, the two setting slots 53 and 54 being directly axially superposed. In contrast to this in the case of the setting as shown in FIG. 5 the degree of overlap is relatively small and the overlapping portion 55, in which the two setting slots 53 and 54 overlap at end portions directed in opposite peripheral directions, is comparatively short.

The two setting slots 53 and 54 have a locking element 56 extending through them in their overlapping portion 55 and fixed in relation to the housing. In the example it is constituted by a screw, whose threaded shank 57 is screwed into a threaded hole in the end 42 of the housing 2 and which is not illustrated in the drawing in detail. Its shank 57 extends through the two setting slots 53 and 54 and its head 58 bears against the axial side 63, facing away from the housing 2, of the top setting ring 39, there preferably being a shim or washer 62 between the head 58 and the said side 63. In this case the head 58 or respectively, the shim 62 acts on the two marginal portions on the ring side laterally bordering the top setting slot 54.

By moving the locking element 56 into its active position, that is to say in the case of a screw, tightening same, the two setting rings 38 and 39 are clamped axially against the housing 2 so that they cannot be turned. If the locking element 56 assumes an inactive position, that is to say released in the case of a screw, it is then possible for the two setting rings 38 and 39 to be rotated in relation to each other and in relation to the housing 2 completely independently of one another.

As a rule it is to be recommended firstly to set the detection position for the one sensor and, only after such setting, to set the detection position for the second sensor. For this reason in the embodiment of the invention the bottom setting ring 38 possesses a further setting slot 64, which is the same in design as the other setting slots 53 and 54, it however differing from the first setting slot 53 of the bottom setting ring 38 in its angular setting and more particularly being diametrally opposite to same. In the example the two setting slots 53 and 54 of the bottom setting ring 38 extend for an angle of approximately 120°.

This further setting slot 64 is furthermore so arranged that it is at least in part underneath the recess 43 of the top setting ring 39. Dependent on the respective angular position of the two setting rings 38 and 39 the further setting slot 64 has a larger or smaller part 65 of its length within or aligned with the recess 43. In the setting in accordance with FIG. 3 the further setting slot 64 is fully accessible, since its entire length is within the recess 43, which in the present element extends for an angle of approximately 200°. In the case of the setting illustrated in FIG. 5 the accessible length section 65 is on the contrary substantially shortened.

A further locking element 66 fixed in relation to the housing is provided, which at the length section 65, which is always accessible, extends through the further setting slot 64 in the bottom setting ring 38. Its structure is the same as that of the above explained first locking element 56 so that additional explanation in this respect is not required.

Thus in the released state of the two locking elements 56 and 66 the holder 35 may be arranged in a desired detection position by turning the setting ring 38 carrying it and the detection position may then be firmly locked by operation of the further locking element 66. Owing to the first locking element 56, which is still released, it is then possible, by turning the top setting ring 39, to set the detection position of the other holder 56, which is then secured in place by tightening the first locking element 56, the bottom setting ring 38 then being simultaneously again clamped between the housing 2 and the top setting ring 39.

Owing to surface to surface engagement between the two setting rings 38 and 39 and with the housing 2 the desired detection positions may be extremely accurately set without any danger of running skew. At the same time there is a firm structure, which even in the case of a miniaturized form of the rotary drive ensures the required degree of strength.

In FIG. 5 in chained lines are employed to indicate that the relative position, which is always maintained during operation, between the actuating member 32 and the output drive shaft 13 may be modified if required. The need for this may arise from the configuration of the abutment means 22 and 22' employed or from the angular setting of such abutment means 22 and 22' in the interior of the working chamber 4.

In order to comply with such requirements, in the embodiment of the invention the carrier 27 for the actuating member 32 can be set in different relative angular positions on the shaft section 26. Preferably the carrier 27 is able to be set in steps at different angles, using a polygonal plug-in joint 67, on the shaft section 26. For this purpose the shaft section 26 may have a polygonal outline, as for instance a square outline, the carrier 27 possessing a complementary recess 68 therefor, using which it may be set on the polygonal shaft section 26 in different angular positions, for example in angular steps of 90°. The attachment of the carrier 27 to the shaft section 26 may for example be performed by providing a holding screw 69 whose head engages the carrier 27 and which extends through the carrier 27 coaxially and is screwed into a threaded hole in the shaft section 26.

The carrier 27 may be a component which is on the outside substantially cylindrical, which has a continuous cylindrical side wall 72 adjoining a radially extending terminating wall 73, through which the holding screw 69 extends. The actuating member 32 is set in a recess 71 in the carrier 27, which in other respects, like the setting rings 38 and 39 and their holders 35 and 36, is preferably manufactured of a magnetically insulating material such as plastic material or, as in the present case, of aluminum stock.

The holders 35 and 36 are in the example so designed that same may serve as universal holders, on which commercially available sensors 37 may be mounted. In the present example same possess an axially aligned recess 74, which on the side facing away from the housing 2, has a receiving opening 75, into which the suitably designed sensor 37 can be inserted as indicated by the arrow 76 axially. Once the position of intended use has been reached it is then possible using a clamping screw 77 provided on the sensor 37, to lock the degree of insertion. Such clamping screw 77 is accessible via a longitudinal slot 78 in the outwardly facing longitudinal side of each respective holder 35 and 36, which preferably extends along the full length of the holding range and at the end merges with the receiving opening 75.

In order to provide the same depth of insertion for both holders 35 and 36 the recess 74 of the holder 36 arranged on the top setting ring 39 is open toward the bottom setting ring 38. The associated sensor may consequently be inserted into the holder 36 until it abuts the bottom setting ring 38. The respective opening 79 may in this case be constituted by a suitable cutout in the top setting ring 39.

Because the bottom setting ring 38 does not have any cutout adjacent to recess 74 in the associated holder 35, that is to say such recess 74 is delimited at the bottom end also by the bottom setting ring 38, there is the same axial depth of mounting of the respective sensor 36. This is something offering the advantage that the functional sensor means of both sensors arranged in each respective sensor 37, of both sensors will at all times assume the same axial position in relation to the actuating member 32 so that reliable detection of position is assured.

Figure 7:
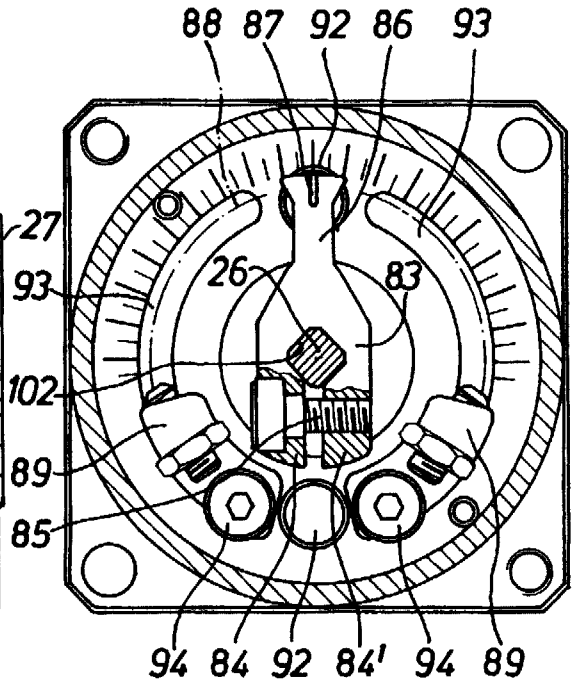
FIG. 7 shows the rotary drive of FIG. 6 in cross section taken on the line of section VII—VII at the means for setting the angle of rotation.
Figure 6:
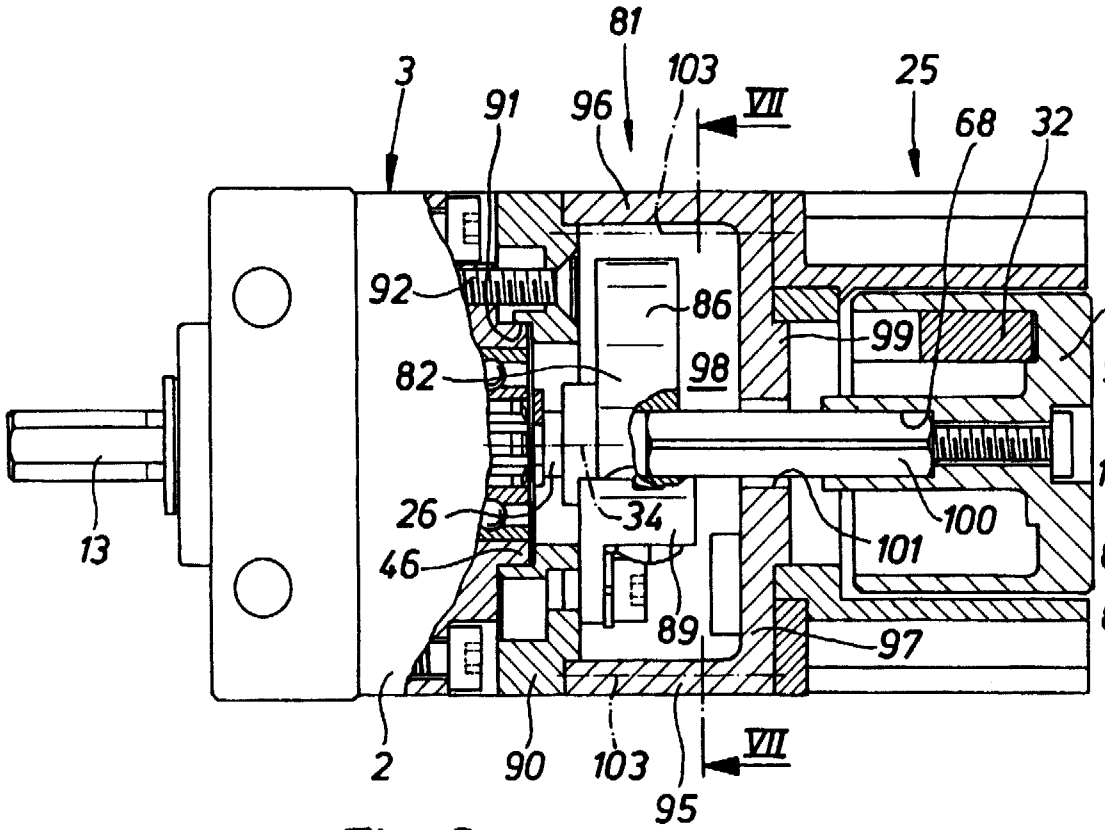
FIG. 6 shows a further embodiment of a rotary drive, which in addition is provided with an angle of rotation setting means, partially in longitudinal section and in a manner similar to that of FIG. 2.

The further embodiment of the invention, depicted in FIGS. 6 and 7, of the rotary drive is as regards the drive means 3 and the position detection means 25, the same in structure as the design of the rotary drive in accordance with FIGS. 1 through 5. Functionally identical parts are hence provided with the same reference numerals. This rotary drive is however additionally provided with angle of rotation setting means 81 not present in the design so far described, such setting means rendering possible an adaptive preset for the angular displacement available at the output drive shaft 13 and which is axially placed between the drive means 3 and the position detection means 25. In the case of such a rotary drive it is possible to dispense with an abutment means for cooperation with the oscillating vane inside the working chamber of the drive means 3, or however it is also possible for such an internal abutment means to be so designed that it presets the maximum possible angle of pivoting of the output drive shaft 13, it being possible to employ the angular displacement setting means 81 to set any desired smaller angles of rotation within this maximum range.

The design of the angle of rotation setting means 81 may as a matter of principle be basically the same as that described in the German patent publication 3,943,716 C2.

The angle of rotation setting means 81 of the embodiment of the invention possesses a pivotal abutment 82, which instead of the carrier 27 is mounted in such a manner as to prevent relative rotation on the shaft section 26 projecting out of the housing 2 of the drive means 3. As shown in FIG. 7 the pivot abutment 82 in the embodiment possesses a holding portion 83, with which it is mounted on the shaft section 26 in such a manner as to prevent relative rotation. The holding portion 83 is slotted and hence possesses two clamping arms 84 and 84', which by means of a screw 85 may be clamped together in order to clamp the pivot abutment 82 in a releasable manner on the shaft section 26.

The pivot abutment 82 furthermore possesses a vane-like pivot arm 86 extending radially from the holding portion 83, in relation to the pivot axis 34, the free end of such arm 86 constituting an abutment portion 87, which on rotary motion of the output drive shaft 13 is pivoted along a circularly arcuate path 88 of movement.

In this path 88 of movement at least one and preferably two counter abutments 89 and 89' are arranged, whose position may be adaptively set along the path 88 of movement. The counter abutments 89 and 89' are borne by a support disk 90, which is mounted concentrically on the bearing portion 46 of the housing 2 and which, absent any angle of rotation setting means 81, may be utilized for centering and fixing the inner setting ring 39. The support disk 90 possesses a central opening 91 so that it may be fitted around the bearing portion 46. The support disk 90 accordingly mounted on the rear end 42 of the housing 2 is fixed in place by means of two attachment screws 92 in a releasable manner on the housing 2, FIG. 6 only showing one of such attachment screws 92.

The support disk 90 is provided with two mutually diametrally opposite circularly arcuate guide slots 93, along which the counter abutments 89 and 89' may run in an adjustable fashion. By means of a fixing screw 94 each respective counter abutment 89 and 89' may be set in position along the associated guide slot 93 in a releasable manner. Because accordingly, as considered in the direction of pivoting, on each side of the abutment portion 87 a respective counter abutment 89 and 89' is arranged in an adjustable manner, it is accordingly possible, in accordance with the adjustment thereof, to preset the pivot angle allowed for the pivot arm 86. In the end positions the pivot arm 86 has its abutment portion 87 running alternatingly against the two counter abutments 89 and 89'. In accordance with the setting of the counter abutments 89 and 89' it is possible in this manner to set the angle of rotation, available at the output drive shaft 13, in an extremely convenient fashion, since the pivot abutment 82 is firmly connected to the output drive shaft 13.

The pivot abutment 82 and the counter abutments 89 are covered over by a cup-like covering hood 95, which is mounted on the support disk 90 which its open side to the fore. Its attachment in position is by means of suitable attachment screws which are merely indicated in chained lines at 103. They are introduced from the axial side opposite to the housing 2 through the covering hood 95 and may be turned from this axial side. The covering hood 95 possesses a tubular peripheral wall 96 and a floor wall 97 formed on the side opposite to the housing 2, such floor wall 97 delimiting, jointly with the peripheral wall 96, a receiving space 98 wherein the pivot abutment 82 and the counter abutments 89 are accommodated.

On its axial side opposite to the housing 2 the floor wall 97 is centrally provided with a further bearing portion 99 corresponding to the bearing portion 46. It is in this manner that at its side axially opposite to its drive means 3 the floor wall 97 has a configuration which is generally the same as that of the rear end side 42 of the housing 2 of the drive means 3. It is in this manner that it is possible to install the position detection means 25 on the outer side of the floor wall 97 in a manner as is indicated in the case of the embodiment in accordance with FIGS. 1 through 5 on the rear end side 42 of the housing 2. For this purpose locking elements 56 and 66 are again employed, not illustrated in detail, which in this case are preferably anchored in the covering hood 95.

In order to maintain the rotary drive connection between the output drive shaft 13 and the carrier 27 fitted with the actuating member 32, the carrier 27 is slipped onto an elongated rod-like coupling member 100, which is received in its recess, such coupling member extending through the floor wall 97 in a central aperture 101 and being fixed in the holding socket 102, which extends through the holding part 83 and by means of which the holding portion 83 is mounted on the shaft section 26. Together with the shaft section 26 the coupling member 100 may be clamped on the holding portion 83 of the pivot abutment 82. The coupling member 100 hence practically constitutes an axial extension of the shaft section 26.

Figure 2:
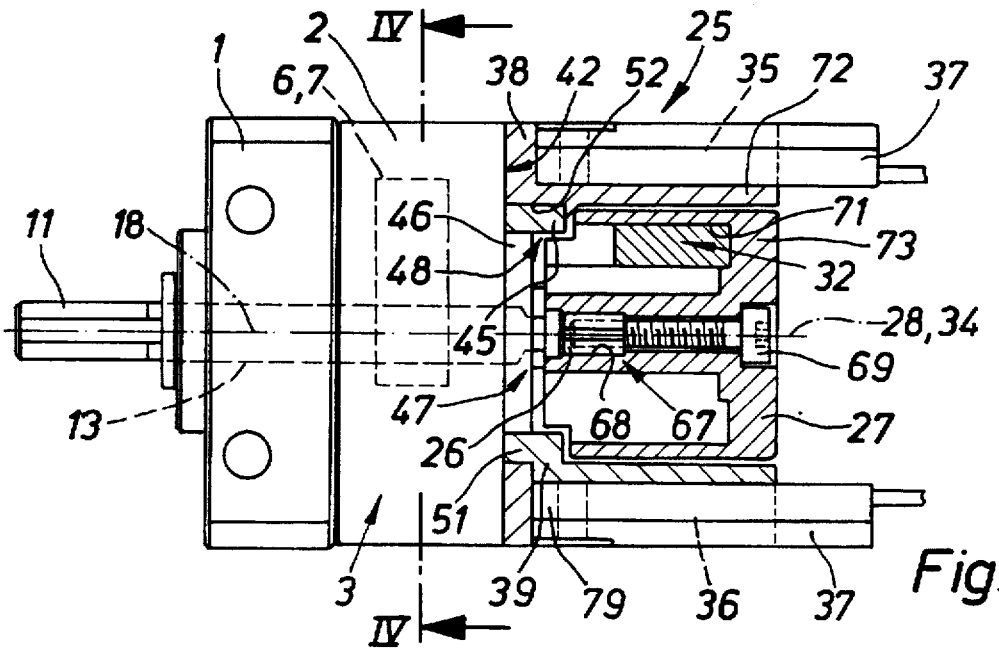
FIG. 2 is a partial longitudinal section taken through the rotary drive of FIG. 1 on the section line II—II.

Owing to the design chosen it is possible to set the position detection means 25 selectively without the intermediate arrangement of the angle of rotation setting means 81 in accordance with FIGS. 1 and 2 or with the intermediate arrangement of the angle of rotation setting means 81 in accordance with FIGS. 6 and 7 on the drive means 3. This means that the invention provides a modular system rendering it possible to assemble the rotary drive according to the respective purpose of use. In this case it is an advantage to make a provision such that the rotary drive 3 may be operated alone only with its drive means 3 or in a combination of the drive means 3 with the angle of rotation setting means 81 and/or the angle of rotation setting means 25. If the rotary drive is only made up of the drive means 33 and the angle of rotation setting means 81, the aperture 101 may be closed by a cover, which is able to be mounted on the axial outer side of the floor wall 97 (not illustrated).

We claim:

1. A fluid operated rotary drive comprising a drive means which has an output drive shaft able to be driven for oscillating motion and has a housing, on whose one axial side a position detecting means is arranged, such position detecting means having at least one actuating member connected in such a manner as to prevent relative rotation with the output drive shaft and adapted, on rotary movement of the output drive shaft, to move along a circularly arcuate path of movement about a pivot axis, and two holders arranged radially to the outside adjacent to the said path of movement of the actuating member, for sensors adapted to respond to the actuating member, said holders being able to be positioned along at least one section of such path of movement in desired detecting positions, wherein each holder is permanently arranged on its own setting ring associated with it, the two setting rings being arranged in axial succession and in superposed relationship centered on the pivot axis of the actuating member, the holders extend, starting from the associated setting ring, in the axially opposite direction to the housing of the drive means, the setting ring placed on top having a recess extending along a section of its periphery for the holder, arranged on the underlying setting ring, to fit through, and for resetting the detection positions the two setting rings are able to be turned in relation to one another and in relation to the housing of the drive means about the pivot axis of the actuating member and may be locked in a releasable manner in the settings made in relation to the housing.

2. The rotary drive as set forth in claim 1, wherein the two setting rings directly engage each other in the axial direction.

3. The rotary drive as set forth in claim 1, further comprising an axially projecting cylindrical bearing portion on the housing of the drive means, such bearing portion being adapted for centering and rotatably supporting the two setting rings.

4. The rotary drive as set forth in claim 3, wherein at an annular opening the top setting ring possesses an annular bearing collar projecting toward the housing of the drive means, same fitting over the cylindrical bearing portion radially to the outside and coaxially and furthermore fitting simultaneously into an annular opening of the bottom setting ring so that the top setting ring is rotatably supported on the bearing portion fixed in relation to the housing and the bottom setting ring is rotatably supported on the bearing collar of the top setting ring.

5. The rotary drive as set forth in claim 1, further having a respective axially continuous arcuate setting slot in the top and in the bottom setting ring, the two setting slots being able to be moved different amounts in the longitudinal direction of the slot by relative rotation of the setting ring in order to overlap and in the overlapped part have a locking element extending through them, such locking element being secured to the housing, which renders possible a ganged releasable locking of the two setting rings.

6. The rotary drive as set forth in claim 5, wherein said bottom setting ring comprises a further axially continuous, arcuate setting slot, which in a manner dependent on the instantaneous relative angular position of the two setting rings assumes a position in the recess in the top setting ring with a larger or smaller length section, the further setting slot having a further locking element, which is secured to the housing, extending through it, such further locking element rendering possible releasable separate fixation in relation to the housing of the bottom setting ring.

7. The rotary drive as set forth in claim 1, wherein the holders are designed in the form of plug-in holders having an axially aligned plug-in opening for a respective sensor.

8. The rotary drive as set forth in claim 1, wherein the actuating member includes a permanent magnet member.

9. The rotary drive as set forth in claim 1, wherein the actuating member is secured on a carrier arranged radially inside the two holders, such carrier being able to be fixed in position on a shaft section, connected with the output drive shaft of the drive means, in different relative angular settings.

10. The rotary drive as set forth in claim 9, wherein the carrier is attached to the said shaft section in a manner allowing for angular resetting in steps using a polygonal plug-in connection means.

11. The rotary drive as set forth in claim 1, wherein the drive means is an oscillating vane means which as a drive member possesses a fluid actuated pivotal vane connected with the output drive shaft, such pivotal vane being accommodated in a pivoting manner in a working chamber in the housing of the drive means.

12. The rotary drive as set forth in claim 11, comprising an abutment means for presetting the maximum pivot angle of the oscillating vane.

13. The rotary drive as set forth in claim 1, comprising, axially between the drive means and the position detection means, an angular displacement setting means for adaptively presetting the possible angular displacement of the output drive shaft.

14. The rotary drive as set forth in claim 13, wherein the design is such that the position detection means is secured in position on the drive means selectively with or without the angular displacement setting means.

* * * * *